US005429348A

United States Patent [19]

Martin

[11] Patent Number: 5,429,348

[45] Date of Patent: Jul. 4, 1995

[54] ADJUSTABLE TOP VACUUM CORRUGTION FEEDER

[75] Inventor: Kathleen M. Martin, Hamlin, N.Y.

[73] Assignee: Xerox Corporation, Stamford, Conn.

[21] Appl. No.: 206,373

[22] Filed: Mar. 7, 1994

[51] Int. Cl.[6] ..... B65H 3/12

[52] U.S. Cl. ..... 271/96; 271/98; 271/171

[58] Field of Search ..... 271/12, 13, 15, 94, 271/96, 98, 104, 105, 171

[56] References Cited

U.S. PATENT DOCUMENTS

| | | | |
|---|---|---|---|
| 3,617,048 | 11/1971 | Albert | 271/171 X |
| 4,157,177 | 6/1979 | Strecker | 271/197 |
| 4,168,829 | 9/1979 | Wilson et al. | 271/171 X |
| 4,269,406 | 5/1981 | Hamlin | 271/108 |
| 4,451,028 | 5/1984 | Holmes et al. | 271/11 |
| 4,699,369 | 10/1987 | Zirilli | 271/94 |
| 5,037,079 | 8/1991 | Siegel et al. | 271/3 |
| 5,181,706 | 1/1993 | Yamamoto et al. | 271/96 X |
| 5,190,276 | 3/1993 | Namba et al. | 271/105 X |

FOREIGN PATENT DOCUMENTS

| | | | |
|---|---|---|---|
| 88734 | 4/1987 | Japan | 271/171 |

*Primary Examiner*—James R. Bidwell
*Assistant Examiner*—Boris Milef

[57] ABSTRACT

A top vacuum corrugation feeder with optimized performance for a large variation in sheet sizes is obtained by adjusting the vacuum port area of a vacuum chamber simply by the action of adjusting the paper guides in the paper tray for different sheet sizes.

10 Claims, 4 Drawing Sheets

40

40

40

40

ADJUSTABLE TOP VACUUM CORRUGTION FEEDER

BACKGROUND OF THE INVENTION

This invention relates generally to a top vacuum corrugation feeder for an electrophotographic printing machine, and more particularly, to a top vacuum corrugation feeder having movable side guides that can be adjusted for feeding a wide variety of document or copy sheet sizes.

Present high speed xerographic copy reproduction machines produce copies at a rate in excess of several thousand copies per hour, therefore, the need for a sheet feeder to feed cut copy sheets to the machine in a rapid, dependable manner has been recognized to enable full utilization of the reproduction machine's potential copy output. In particular, for many purely duplicating operations, it is desired to feed cut copy sheets at very high speeds where multiple copies are made of an original placed on the copying platen. In addition, for many high speed copying operations, a document handler to feed documents from a stack to a copy platen of the machine in a rapid dependable manner also been reorganized to enable full utilization of the machine's potential copy output. These sheet feeders must operate flawlessly to virtually eliminate the risk of damaging the sheets and generate minimum machine shutdowns due to uncorrectable misfeeds or sheet multifeeds. It is in the initial separation of the individual sheets from the sheet stack where the greatest number of problems occur.

One of the sheet feeders best known for high speed operation is the top vacuum corrugation feeder with front air knife. In this system, a vacuum plenum with a plurality of friction belts arranged to run over the vacuum plenum is placed at the top of a stack of sheets in a supply tray. At the front of the stack, an air knife is used to inject air into the stack to separate the top sheet from the remainder of the stack. In operation, air is injected by the air knife toward the stack to separate the top sheet, the vacuum pulls the separated sheet up and acquires it. Following acquisition, the belt transport drives the sheet forward off the stack of sheets. In this configuration, separation of the next sheet cannot take place until the top sheet has cleared the stack. In this type of feeding system every operation takes place in succession or serially, and therefore, the feeding of subsequent sheets cannot be started until the feeding of the previous sheet has been completed. In addition, in this type of system the air knife may cause the second sheet to vibrate independent of the rest of the stack in a manner referred to as "flutter". When the second sheet is in this situation, if it touches the top sheet, it may tend to creep forwardly slightly with the top sheet. The air knife then may drive the second sheet against the first sheet causing a shingle or double feeding of sheets. Also, some current top and bottom vacuum corrugation feeders utilize a valved vacuum feedhead, e.g., U.S. Pat. Nos. 4,269,406 and 4,451,028. At the appropriate time during the feed cycle the valve is actuated, establishing a flow and hence a negative pressure field over the stack top or bottom if a bottom vacuum corrugation feeder is employed. This field causes the movement of the top sheet(s) to the vacuum feedhead where the sheet is then transported to the take-away rolls. Once the sheet feed edge is under control of the take-away rolls, the vacuum is shut off. The trail edge of this sheet exiting the feedhead area is the criteria for again activating the vacuum valve for the next feeding. A top vacuum corrugation feeder with a valveless vacuum system is shown in U.S. Pat. No. 4,699,369 and all of the heretofore mentioned patents are included herein by reference.

Current customer requirements for middle volume machines include the furnishing of sheet feeders that handle sheets ranging in size from A6 to 12"×18". If the port area of a vacuum feedhead of a top vacuum corrugation feeder is designed for the A6 size sheets, there may be insufficient flow and pressure to acquire and feed the larger sheets. However, if the air system is designed for the larger sheets, smaller sheets will not cover all of the port openings, allowing air leakage and reducing feeder performance. Therefore, an improved feeder is needed that will reliably feed a wide variety of sheet sizes.

PRIOR ART

U.S. Pat. No. 4,157,177 (Strecker) illustrates another sheet stacker wherein a first belt conveyor delivers sheets in a shingled fashion and the lower reach of a second perforated belt conveyor which is above the top of the stacking magazine attracts the leading edge of the sheets. The device has a slide which limits the effect of perforations depending on the size of the shingled sheet.

U.S. Pat. No. 5,037,079 (Siegel et al.) is directed to a vacuum platen transport system that includes a shutter mechanism which is connected to a side guide of a document handler. Movement of the side guides closes off holes in the vacuum plenum in accordance with the size of documents placed in the document handler.

SUMMARY OF THE INVENTION

In accordance with the present invention, a top sheet feeding apparatus is disclosed as comprising a sheet stack support tray for supporting a stack of sheets within the tray, air knife means positioned immediately adjacent the front of said stack of sheets for applying a positive pressure to the sheet stack in order to separate the uppermost sheet in the stack from the rest of the stack, and feedhead means including a vacuum plenum chamber positioned over the front of the sheet stack having a negative pressure applied thereto during feeding, said vacuum plenum chamber having perforated feed belt means associated with said vacuum plenum chamber to transport the sheets acquired by said vacuum plenum chamber in a forward direction out of the stack support tray, characterized by said sheet stack support tray including adjustable side guides with hard or soft cover members attached thereto that are adapted to cover overlying port areas of said vacuum plenum chamber in order to optimize the performance of the sheet feeding apparatus for a large variation in sheet sizes.

For a better understanding of the invention as well as other objects and further features thereof, reference is made to the following drawings and descriptions.

DESCRIPTION OF THE PREFERRED EMBODIMENT

While the present invention will be described hereinafter in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 6:
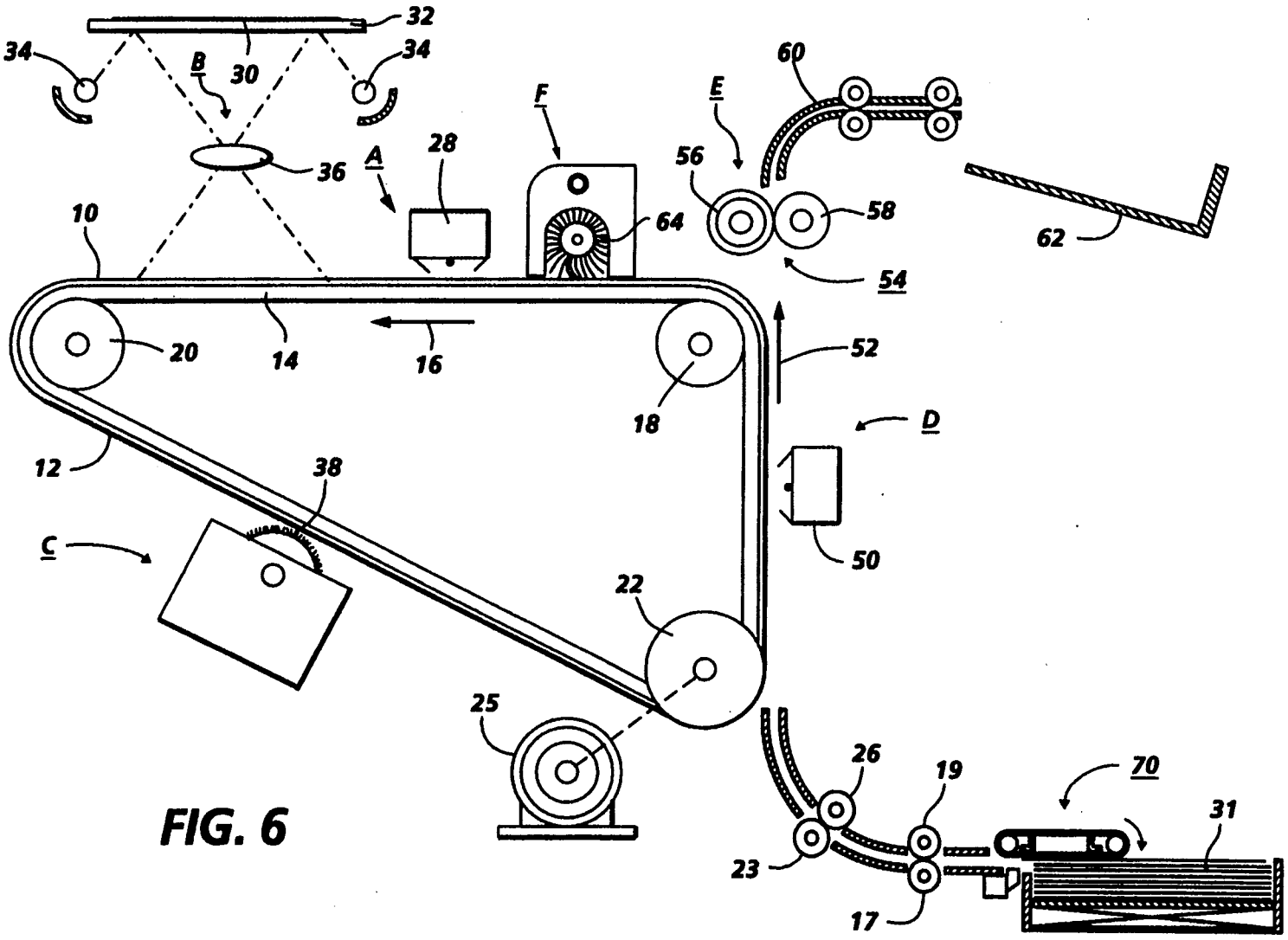
FIG. 6 is a schematic elevational view of an electrophotographic printing machine incorporating the features of the present invention therein.

For a general understanding of the features of the present invention, reference is had to the drawings. In the drawings, like reference numerals have been used throughout to designate identical elements. FIG. 6 schematically depicts the various components of a illustrative electrophotographic printing machine incorporating the top feed vacuum corrugation feeder method and apparatus of the present invention therein. It will become evident from the following discussion that the sheet feeding system disclosed herein is equally well suited for use in a wide variety of devices and is not necessarily limited to its application to the particular embodiment shown herein. For example, the apparatus of the present invention may be readily employed in non-xerographic environments and substrate transportation in general.

Inasmuch as the art of electrophotographic printing is well known, the various processing stations employed in the FIG. 1 printing machine will be shown hereinafter schematically and the operation described briefly with reference thereto.

As shown in FIG. 6, the electrophotographic printing machine employs a belt 10 having a photoconductive surface 12 deposited on a conductive substrate 14. Preferably, photoconductive surface 12 is made from an aluminum alloy. Belt 10 moves in the direction of arrow 16 to advance successive portions of photoconductive surface 12 sequentially through the various processing stations disposed about the path of movement thereof. Belt 10 is entrained around stripper roller 18, tension roller 20, and drive roller 22.

Drive roller 22 is mounted rotatably in engagement with belt 10. Roller 22 is coupled to a suitable means such as motor 25 through a belt drive. Motor 25 rotates roller 22 to advance belt 10 in the direction of arrow 16. Drive roller 22 includes a pair of opposed spaced flanges or edge guides (not shown). Preferably, the edge guides are circular members or flanges.

Belt 10 is maintained in tension by a pair of springs (not shown), resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 6, initially a portion of belt 10 passes through charging station A. At charging station A, a corona generating device, indicated generally by the reference numeral 28, charges photoconductive surface 12 of the belt 10 to a relatively high, substantially uniform potential.

Next, the charged portion of photoconductive surface 12 is advanced through exposure station B. At exposure station B, an original document 30 is positioned face down upon transparent platen 32. Lamps 34 flash light rays onto original document 30. The light rays reflected from the original document 30 are transmitted through lens 36 from a light image thereof. The light image is projected onto the charged portion of the photoconductive surface 12 to selectively dissipate the charge thereon. This records an electrostatic latent image on photoconductive surface 12 which corresponds to the information areas contained within original document 30.

Thereafter, belt 10 advances the electrostatic latent image recorded on photoconductive surface 12 to development station C. At development station C, a magnetic brush developer roller 38 advances a developer mix into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material is moved into contact with the toner powder image. The sheet support material is advanced toward transfer station D by top vacuum corrugation feeder 70. Preferably, the feeder includes an air knife 80 which floats a sheet 31 up to where it is grabbed by the suction force from vacuum plenum 75. A perforated feed belt 71 then forwards the now separated sheet for further processing, i.e., the sheet is directed through rollers 17, 19, 23, and 26 into contact with the photoconductive surface 12 of belt 10 in a timed sequence by suitable conventional means so that the toner powder image developed thereon synchronously contacts the advancing sheet of support material at transfer station D.

Transfer station D includes a corona generating device 50 which sprays ions onto the backside of a sheet passing through the station. This attracts the toner powder image from the photoconductive surface 12 to the sheet and provides a normal force which causes photoconductive surface 12 to take over transport of the advancing sheet of support material. After transfer, the sheet continues to move in the direction of arrow 52 onto a conveyor (not shown) which advances the sheet to fusing station E.

Fusing station E includes a fuser assembly, indicated generally by the reference number 54, which permanently affixes the transferred toner powder image to the substrate. Preferably, fuser assembly 54 includes a heated fuser roller 56 and a backup roller 58. A sheet passes between fuser roller 56 and backup roller 58 with the toner powder image contacting fuser roller 56. In this manner, the toner powder image is permanently affixed to the sheet. After fusing, chute 60 guides the advancing sheet to catch tray 62 for removal from the printing machine by the operator.

After the sheet support material is separated from the photoconductive surface 12 of belt 10, some residual particles remain adhering thereto. These residual particles are removed from photoconductive surface 12 at cleaning station F. Cleaning station F includes a rotatably mounted brush 64 in contact with the photoconductive surface 12. The particles are cleaned from photoconductive surface 12 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient to illustrate the general operation of an electrostatographic machine.

Figure 1:
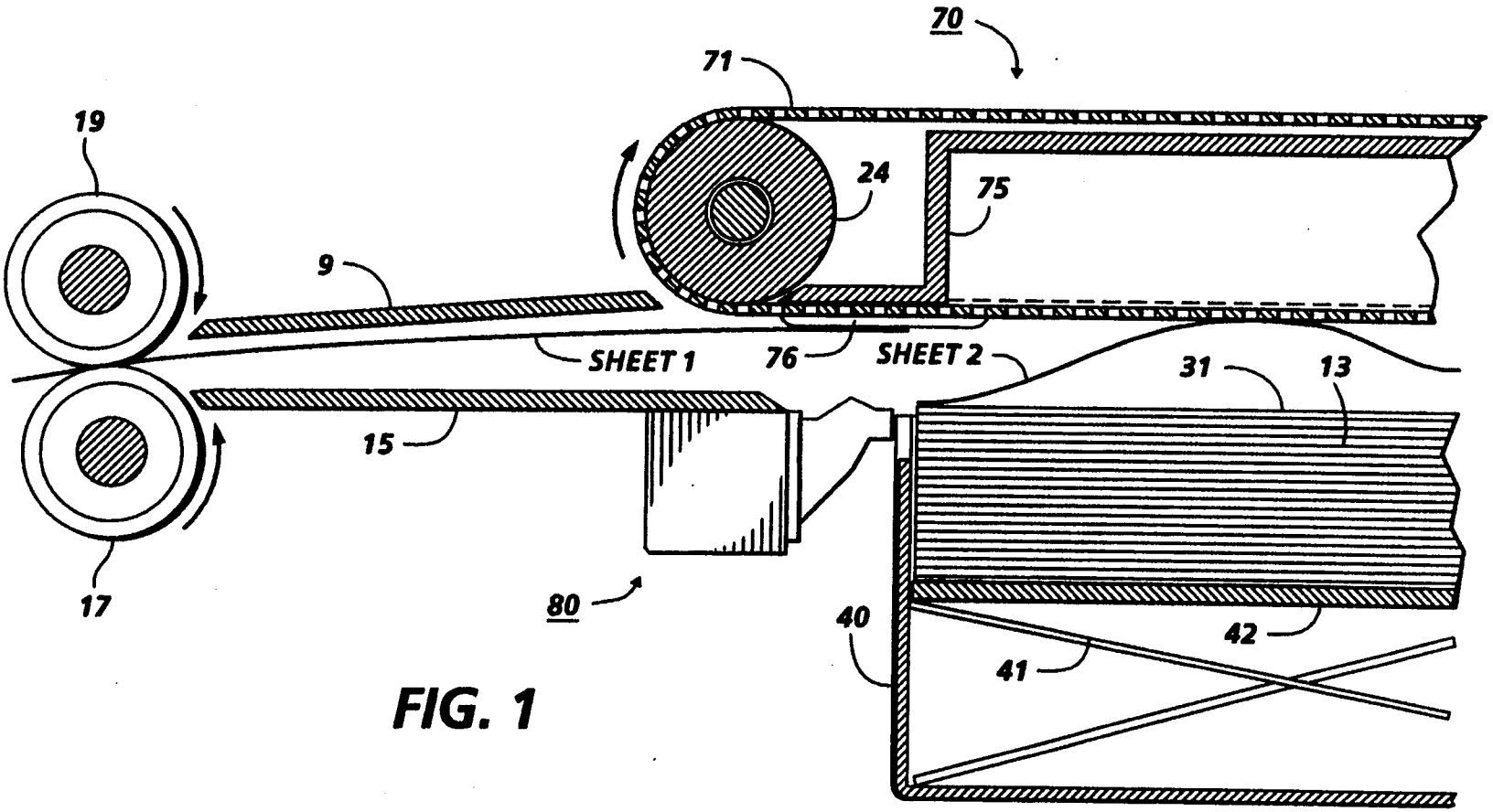
FIG. 1 is an enlarged partial cross-sectional view of the exemplary feeder in FIG. 6 which is employed in accordance with the present invention.

Referring now to a particular aspect of the present invention, FIGS. 1–6 show a system employing the present invention in a copy sheet feeding mode. Alternately, or in addition, the sheet feeder may be mounted for feeding document sheets to the platen of a printing machine. The sheet feeder is provided as shown in FIG. 1 with a conventional elevator mechanism 41 for raising and lowering either tray 40 or a platform 42 within tray 40. Ordinarily, a drive motor is actuated to move the sheet stack support platform 42 vertically by a stack height sensor positioned above the rear of the stack when the level of sheets relative to the sensor falls below a first predetermined level. The drive motor is deactuated by the stack height sensor when the level of the sheets relative to the sensor is above a predetermined level. In this way, the level of the top sheet in the stack of sheets may be maintained within relatively narrow limits to assure proper sheet separation, acquisition and feeding.

Figure 2:
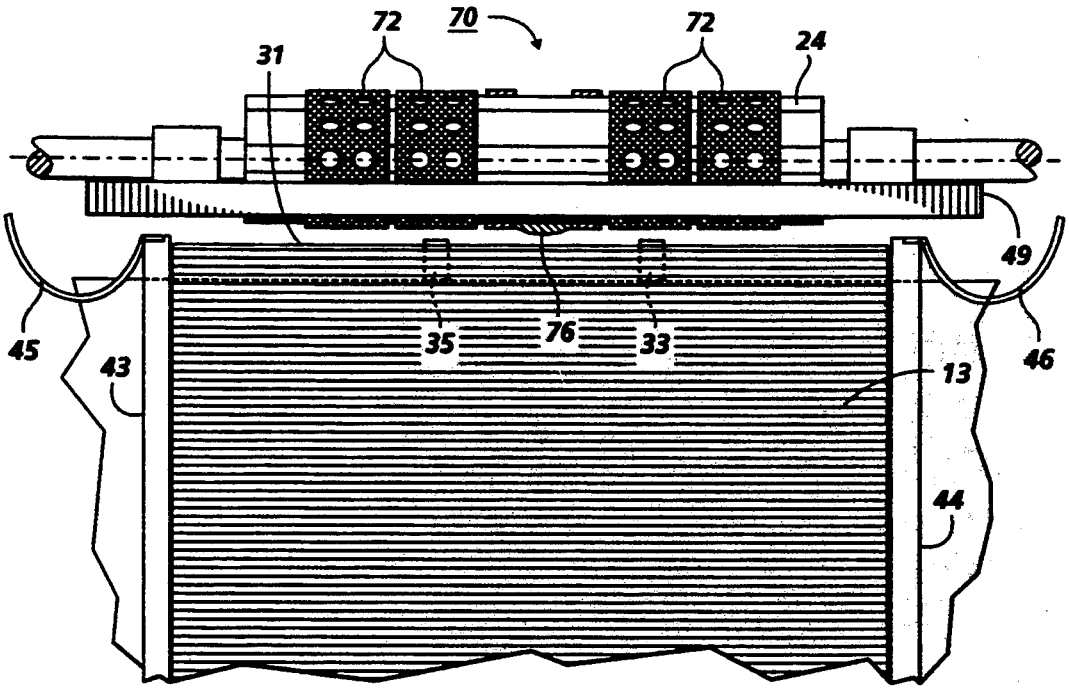
FIG. 2 is a partial rear end view of the paper tray shown in FIGS. 1 and 6 with 12"×18" sheets stacked therein and showing flexible vacuum port cover members outside the vacuum port area of the vacuum feedhead.

Tray 40 in FIG. 2 includes adjustable side guides 43 and 44 that are laterally or transversely movable with respect to the direction of transport of the sheets in any suitable conventional manner. The side guides have flexible members 45 and 46 attached to their upper ends adjacent to vacuum feedhead 70 such that the flexible members are adapted to abut against or not abut against support 49 when the side guides are moved toward or away from each other and vacuum pressure is applied through ports 72 of belts 71. Vacuum corrugation feeder 70 and a vacuum plenum 75 in FIG. 1 are positioned over the front end of a tray 40 having copy sheets 31 stacked therein. Belts 71 are entrained around drive rollers 24, as well, as plenum 75. Belts 71 could be made into a single belt if desired. Perforations or ports 72 in the belts allow a suitable vacuum source (not shown) to apply a vacuum through plenum 75 and belts 71 to acquire sheets 31 from stack 13. Air knife 80 applies a positive pressure to the front of stack 13 to separate the top sheet in the stack and enhance its acquisition by vacuum plenum 75. Corrugation rail 76 is attached or molded into the underside and center of plenum 75 and causes sheets acquired by the vacuum plenum to bend during the corrugation so that if a second sheet is still sticking to the sheet having been acquired by the vacuum plenum, the corrugation will cause the second sheet to detack and fall back into the tray. A sheet captured on belts 71 is forwarded through baffles 9 and 15 and into forwarding drive rollers 17 and 19 for transport to transfer station D. In order to prevent multifeeding from tray 40, a pair of restriction members 33 and 35 are attached to the upper front end of tray 40 and serve to inhibit all sheets other than sheet 1 from leaving the tray. It is also possible to place these restriction members or fangs on the air knife instead of the tray. Vacuum plenum 75 is preferably equipped with a negative pressure source that is ON continuously during the feed cycle, with the only criteria for sheet feeding being that the motion of vacuum feedhead 70 is ceased prior to the trail edge of the acquired sheet exposing all of the vacuum ports. The next sheet is then acquired in a "traveling wave" fashion as shown in FIG. 2. This feeding scheme affords a reduction in noise due to the elimination of the valve associated with cutting the vacuum means ON and OFF.

Figure 3:
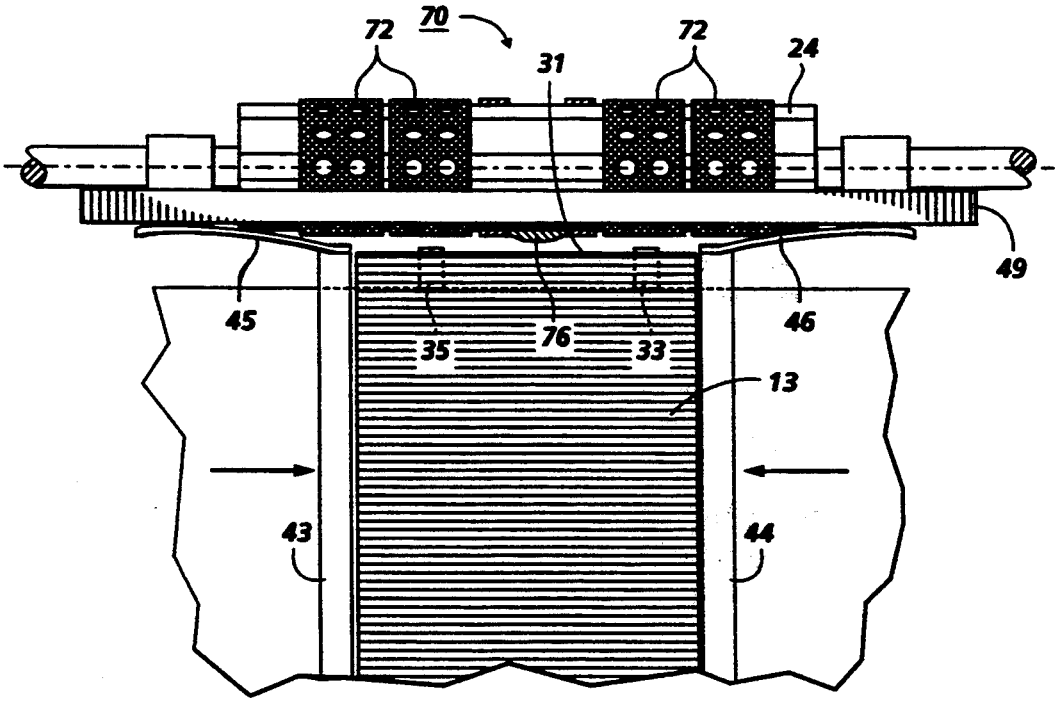
FIG. 3 is a partial rear end view of the paper tray shown in FIG. 2 with A6 sheets stacked therein and showing flexible vacuum port cover members closing off portions of the area around the vacuum feedhead.

The addition of flexible members 45 and 46 to adjustable side guides 43 and 44 enable the reliable feeding of a wide variety of sheet sizes through the sheet feed apparatus. Feeding of large sheets, such as, 12"×18" as shown in FIG. 2, is assured since sufficient flow and pressure to the vacuum feedhead is maintained by flexible cover members 45 and 46 being outside the influence of the vacuum port areas of the belts. However, when small sheets, e.g., A6 size, are in tray 40 as shown in FIG. 3, the side guides are moved into position toward each other and the flexible covers will be pulled up by the vacuum feedhead to abut against support member 49 and effectively close off some of the vacuum originating through some of the holes in the belts that are not covered by a sheet. Thus, air leakage is blocked and feeder performance is enhanced.

Figure 4:
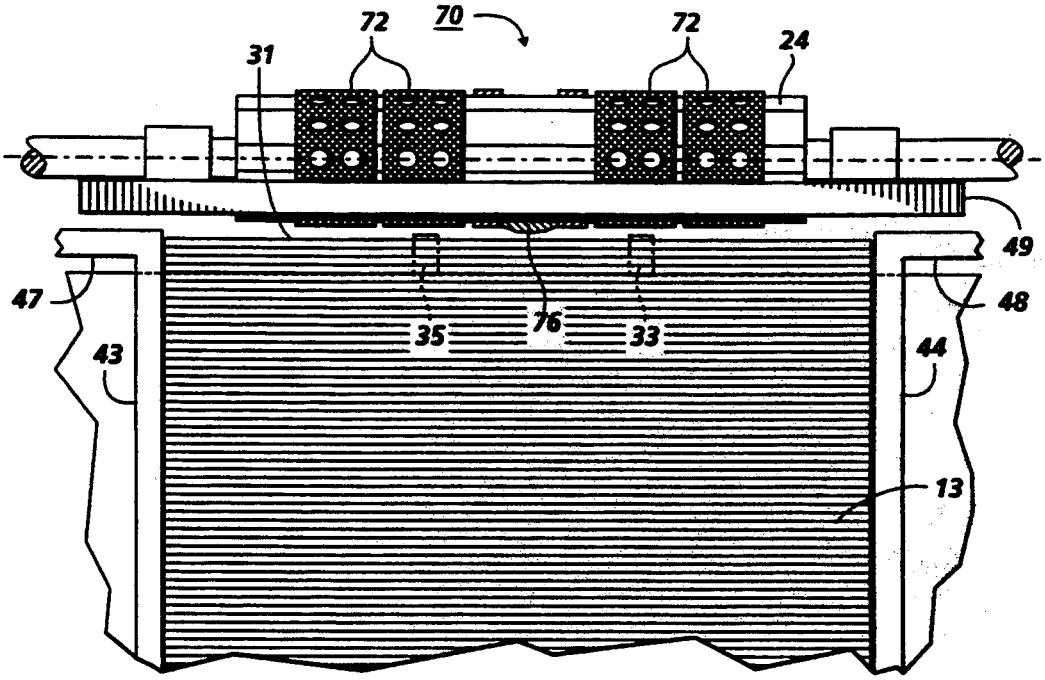
FIG. 4 is a partial rear end view of the paper tray shown in FIG. 2 with 12"×18" sheets stacked therein and showing rigid vacuum enhancing members outside the vacuum port area of the vacuum feedhead.
Figure 5:
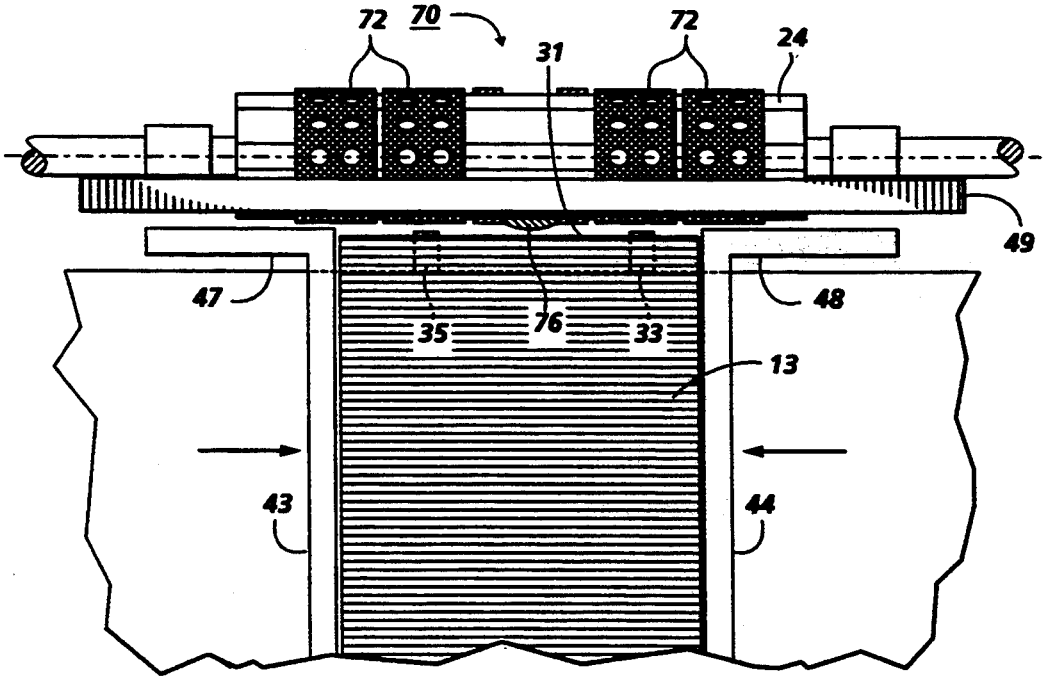
FIG. 5 is a partial rear end view of the paper tray shown in FIG. 2 with A6 sheets stacked therein and showing rigid vacuum enhancing members moved closer to the vacuum feedhead.

Alternatively, as shown in FIGS. 4 and 5, rigid plates 47 and 48 could be integral with or attached to adjustable side guides 43 and 44, respectively, if desired. In FIG. 4, rigid plates 47 and 48 are positioned outside the vacuum port area of belts 71 and have no effect on the vacuum pressure of feedhead 70 while inwardly positioned side guides 43 and 44 in FIG. 5 shows plates 47 and 48 closer to the vacuum ports 72 of belts 71 and serving to thereby minimizing the leakage of air that would normally occur with smaller size sheets in the tray.

In conclusion, a modification to the side guides for a top vacuum corrugation feeder is disclosed which allows improved feeding performance for a wide variety of sheet sizes from 12"×18" to A6. Either flexible or rigid material is added to the upper ends of the side guides to seal or partially block off any air leakage that might be exposed when small sheets are in the feeder. This allows the use of a feedhead which has been optimized for larger sheets, because the port size will be customized for smaller sheets through the movement of the side guides. This will reduce the air leakage for the smaller sheets which in turn will improve performance of the feeder. It should be understood that instead of both side guides being adjustable, only one side guide could be adjustable, if desired.

It is, therefore, evident that there has been provided in accordance with the present invention a nip sheet sensing scheme has been disclosed which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A top sheet feeding apparatus comprising a sheet stack support tray for supporting a stack of sheets within the tray, air knife means positioned immediately adjacent the front of said stack of sheets for applying a positive pressure to the sheet stack in order to separate the uppermost sheet in the stack from the rest of the stack, and feedhead means including a vacuum plenum chamber positioned over the front of the sheet stack having a negative pressure applied thereto during feeding, and perforated feed belt means associated with said vacuum plenum chamber to transport the sheets acquired by said vacuum plenum chamber in a forward direction out of the stack support tray, characterized by said sheet stack support tray including adjustable side guides, and wherein said adjustable side guides have end portions extending laterally therefrom that are adapted to close off an area around said vacuum chamber when they are adjusted to accommodate small sheet sizes, and wherein said end portions extending laterally from said side guides are flexible members.

2. The top sheet feeding apparatus of claim 1, wherein said vacuum plenum chamber includes a sheet corrugation member located in the center of its bottom surface.

3. The top sheet feeding apparatus of claim 1, wherein said end portions extending laterally from said side guides partially close off vacuum pressure through said perforated feed belt means.

4. A top sheet feeding apparatus comprising a stack support tray for supporting a stack of sheets within the tray, and feedhead means including a vacuum plenum chamber positioned over the front of the sheet stack having a negative pressure applied thereto during feeding, said vacuum plenum chamber having perforated feed belt means associated therewith to transport the sheet acquired by said vacuum plenum chamber in a forward direction out of the stack support tray, characterized by said sheet stack support tray including adjustable side guides, and wherein said adjustable side guides have end portions extending orthogonally from a vertical portion of the side guides positioned adjacent the side of the stack of sheets, said orthogonal end portions are adapted to restrict air leakage from said vacuum chamber when the vertical portions of said side guides are positioned in substantial sheet stack contacting relationship with predetermined sheet sizes, and wherein said orthogonal end portions of said side guides are flexible members.

5. The top sheet feeding apparatus of claim 4, wherein said vacuum plenum chamber includes a sheet corrugation member located in the center of its bottom surface.

6. The top sheet feeding apparatus of claim 4, comprising air knife means positioned immediately adjacent the front of said stack of sheets for applying a positive pressure to the sheet stack in order to separate the uppermost sheet in the stack from the rest of the stack.

7. The top sheet feeding apparatus of claim 4, wherein said perforated feed belt means includes a plurality of endless belts rotatably entrained around said vacuum plenum.

8. A top sheet feeding apparatus, comprising: a stack support tray for supporting a stack of sheets within the tray; air knife means positioned immediately adjacent the front of said stack of sheets for applying a positive pressure to the sheet stack in order to separate the uppermost sheet in the stack from the rest of the stack; a feeding device including a vacuum plenum chamber positioned over the front of the sheet stack having a negative pressure applied thereto during feeding, said feeding device including a series of rotatably mounted perforated belts surrounding said vacuum chamber and adapted when rotated to transport a copy sheet attracted thereto by said vacuum chamber out of said sheet stack; and wherein said stack support tray includes adjustable side guides extending along the height of the sheet stack, said adjustable side guides having flexible end portions thereof extending orthogonal thereto and adapted to restrict the leakage of air from said perforated feed belts when said side guides are moved a predetermined distance towards each other to thereby enhance the ability of said vacuum chamber to attract a wide variety of sheet sizes to said perforated feed belts.

9. The top sheet feeding apparatus of claim 8, wherein said vacuum plenum chamber includes a sheet corrugation member located in the center of its bottom surface.

10. The top sheet feeding apparatus of claim 8, including a support member positioned adjacent said vacuum plenum chamber, and wherein said flexible end portions are attracted to said support member by said vacuum chamber when predetermined sheet sizes are fed by said top sheet feeding apparatus.

* * * * *